US008113032B2

(12) United States Patent
Utpadel et al.

(10) Patent No.: US 8,113,032 B2
(45) Date of Patent: Feb. 14, 2012

(54) PUNCH DEVICE

(75) Inventors: Ralph Utpadel, Wendlingen (DE); Gerhard Pick, Wäschenbeuren (DE); Markus Röver, Stuttgart (DE); Jörg Vögele, Göppingen (DE)

(73) Assignee: Schuler Pressen GmbH & Co., KG, Göppingen (DE)

( * ) Notice: Subject to any disclaimer, the term of this patent is extended or adjusted under 35 U.S.C. 154(b) by 0 days.

(21) Appl. No.: 11/730,851

(22) Filed: Apr. 4, 2007

(65) Prior Publication Data

US 2007/0227223 A1 Oct. 4, 2007

(30) Foreign Application Priority Data

Apr. 4, 2006 (DE) ..... 10 2006 015 711

(51) Int. Cl.
*B21D 43/00* (2006.01)
*B21C 51/00* (2006.01)

(52) U.S. Cl. ..... 72/421; 72/20.1; 72/20.2

(58) Field of Classification Search ..... 72/20.1, 72/20.2, 20.3, 20.5, 21.6, 420, 421, 404, 72/405.01, 332, 333, 419, 422, 361, 443; 83/248, 527, 530, 550, 620, 622, 688
See application file for complete search history.

(56) References Cited

U.S. PATENT DOCUMENTS

| | | | | |
|---|---|---|---|---|
| 5,816,093 | A * | 10/1998 | Takeuchi et al. | 72/327 |
| 2002/0002887 | A1 * | 1/2002 | Kubota et al. | 83/13 |
| 2003/0015012 | A1 * | 1/2003 | Nagakura | 72/31.11 |
| 2004/0069105 | A1 * | 4/2004 | Martin et al. | 83/30 |
| 2005/0132903 | A1 * | 6/2005 | Nagae | 100/280 |

FOREIGN PATENT DOCUMENTS

| | | | |
|---|---|---|---|
| DE | 101 07 484 | A1 | 9/2002 |
| EP | 0 364 715 | A1 | 4/1990 |

* cited by examiner

*Primary Examiner* — Debra Sullivan
(74) *Attorney, Agent, or Firm* — Fitch Even Tabin & Flannery LLP; Norman N. Kunitz

(57) ABSTRACT

Referring to a punch device in accordance with the invention, the punch stamp (10) is driven by a hydraulic actuating drive (6), in which case, in connection with an advance device (4) driven by a servo motor and travel-measuring systems on the ram axis and on the partial-apparatus axis (advance axis), the ram movement is freely programmable relative to the advance movement of the partial apparatus.

11 Claims, 3 Drawing Sheets

PUNCH DEVICE

CROSS REFERENCE TO RELATED APPLICATION

This application claims the priority of German Patent Application No. 10 2006 015 711.7-14, filed on Apr. 4, 2006, the subject matter of which, in its entirety, is incorporated herein by reference.

BACKGROUND OF THE INVENTION

The invention relates to a punch device for electric sheets, in particular, for punching rotor sheets or stator sheets for electrical machines.

In the production of electric sheets, in particular metal sheets for electrical machines, various fabrication processes can be used to provide these sheets with stator notches or grooves, rotor notches or grooves, ventilation holes or other cutouts. To achieve this, frequently so-called notching presses are used for single-notch processes, in which notches or grooves are produced individually, one after the other. This method combines cost-effectiveness with high flexibility when different punch radii and a large variety of hole patterns are to be produced. Loading and unloading the notching press is done either manually or automatically.

An example of a notching press has been disclosed by document DE 101 07 484 A1. This reference discloses a mechanical ram drive that allows the adjustment of the pivot axis of a force-transmitting lever via an eccentric. A servo motor is used for the adjustment of this eccentric. Thus, the press stroke of the punch device can be adjusted during operation.

Referring to this solution, the maximum applicable force is a function of the position of the eccentric because said eccentric changes the effective length of the lever arms of the pivot lever, depending on the position of rotation. If an eccentric with minimal eccentricity is used, the degree of stroke adjustment is likewise minimal.

Document EP 0364715 also discloses a notching press system with a mechanical ram drive. Again, an eccentric is used to adjust the stroke length, said eccentric being adjusted via a pneumatic cylinder. The adjustment of the stamp stroke is fixed by the end positions of the drive cylinder.

Considering this, the object of the invention is to provide an improved device for the automatic punching of electric sheets.

SUMMARY OF THE INVENTION

This object is attained with a device exhibiting the features of patent claim 1:

The inventive device comprises an actuating drive for the punch tool, whereby said drive is connected to the ram in order to adjust said ram in a travel-controlled manner so that a punch stroke may take place. The current travel detection is achieved by a travel-measuring device, for example, designed as a linear displacement sensor. The latter can detect the position of the actuating drive or the position of the ram. Furthermore, the punch device in accordance with the invention comprises an advance device for the controlled movement of the electric sheets with respect to the matrix of the punch tool. The combination of a freely programmable ram/travel relationship and a freely programmable advance device permits an optimal adjustment of the punching times and transport times, i.e., without any restrictions, which would normally inevitably result from mechanical driving kinematics. In addition, the loading and unloading positions can be started up in manual or automatic mode in a time-optimized manner. This, in turn, is reflected by an output that is increased in comparison with current state-of-the-art machines.

The actuating drive may be an electric, rotational or linear drive. Preferably, it is a servo drive which operates with continuous position control. Furthermore, the actuating drive may be a hydraulic cylinder whose piston is connected to the ram in order to drive said ram. Preferably, the connection is direct—i.e., without any interposed gearing—via a rod or via a direct connection of the ram to the piston. The ram is separately guided. Preferably, a disengagement between actuating the drive and the ram is provided with respect to directions that are oriented transverse to the direction of movement of the stamp. The transmission of motion in the direction of movement of the stamp is preferably backlash-free.

The hydraulic cylinder represents a direct drive for the ram. Said cylinder defines a maximum stroke that is greater than a punch stoke. Preferably, the maximum stroke is greater than a lifting stroke as is required for a tool change or a work piece change. Consequently, all ram movements can be freely programmed and defined. The movement of the punch stamp is preferably effected position-controlled at any time. However, alternatively, it is also possible to define only specific points of the path of movement of the ram, for example, its upper and lower dead centers, as well as the times at which said ram must reach, or must leave, said dead centers. In this case, the position-regulated control occurs only in time segments via the ram movement.

Preferably, the hydraulic cylinder is controlled via electrically actuated valves. These are preferably designed as rapidly switching electrically actuated valves that are controlled by the control device. Thus, the control device can control the movement of the actuating drive, its positions and its momentary speeds.

The advance device comprises at least one servo motor, which is connected to a seat for the electric sheet, preferably directly or also—via a gearing stage—at least indirectly. Thus the position of rotation of the servo motor corresponds to the position of rotation of the electric sheet. If the connection does not include any gearing, gearing play or the like is avoided. The position controller of the servo motor can thus be easily used for positioning the electric sheet. Special travel recorders are not necessary.

The actuating drive of the ram, as well as the servo motor of the advance device, permit a continuous adjustment of the punching widths and transport steps, respectively. However, for example, it is also possible to use the software of the control device to pre-specify steps or increments for the adjustment of the movements of the actuating drive and the advance device.

Additional details of advantageous embodiments of the present invention result from the figures, the description of the figures and the claims.

The drawings show an advantageous embodiment of the invention.

DETAILED DESCRIPTION OF THE INVENTION

Figure 1:
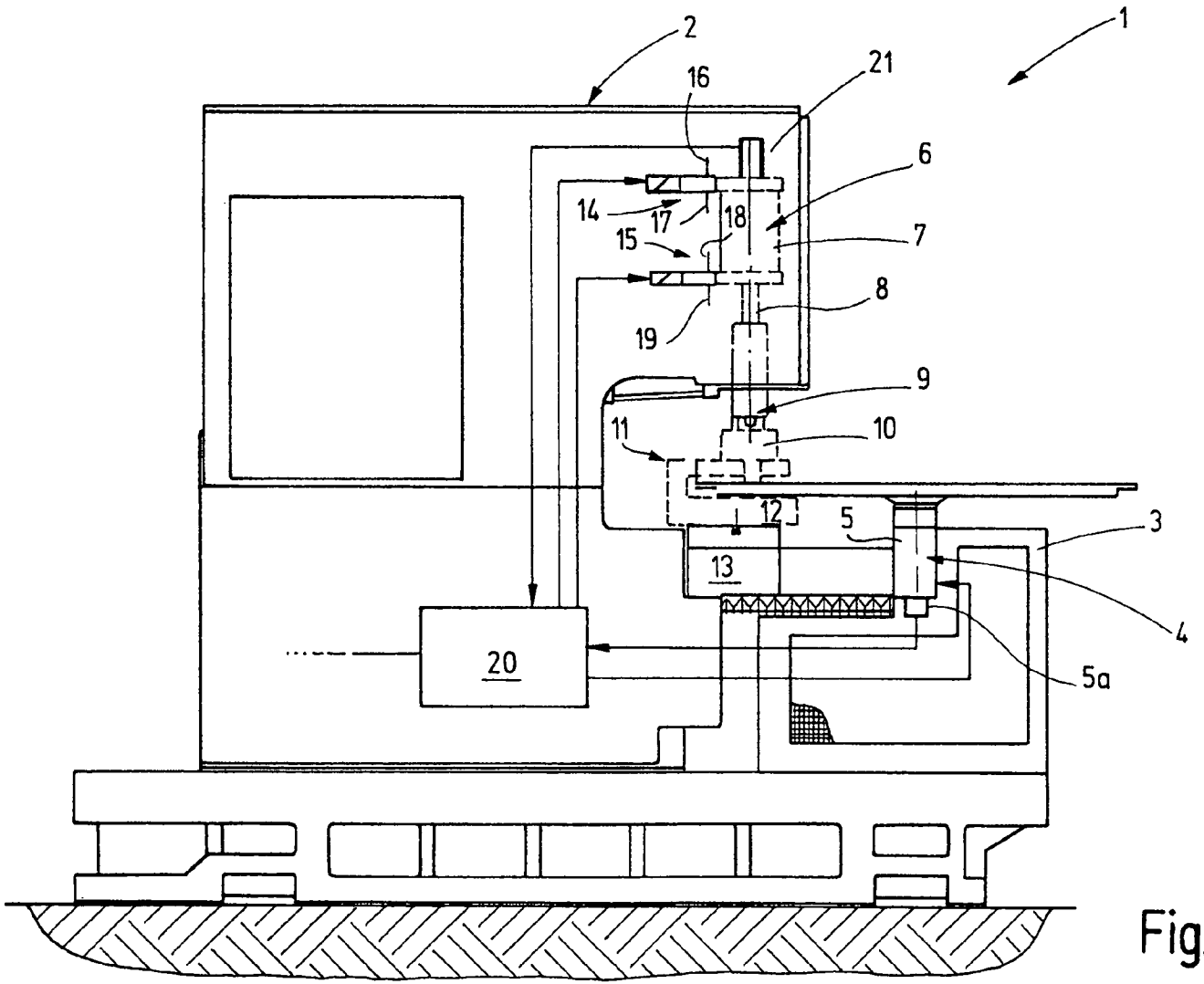
FIG. 1 is a schematic side view of a punch device according to the invention.

FIG. 1 shows a punch device 1 with a machine frame 2 comprising a table 3 that is preferably adjustable in at least one direction. Preferably, this table can be adjusted in horizontal direction by means of an actuating drive that is not illustrated in detail. The table 3 supports an advance device 4 that is used for positioning an electric sheet that is not illustrated in detail, when said electric sheet is to be punched. The advance device 4 comprises a servo motor 5, whose output is connected directly or indirectly to a support for the electric sheet. Furthermore, the servo motor 5 may comprise an incremental or other angle sensor 5*a* which detects the rotational position of the servo motor 5 and thus also the rotational position of the electric sheet to be punched. To achieve this, the electric sheet is mounted in a non-rotational manner to the support that is actuated by the servo motor 5 during the machining operation.

In addition, the machine frame 2 supports an actuating drive 6, for example in the form of a hydraulic cylinder 7, whose output 8 in the form of a piston rod is connected to a seat 9 for a punch stamp 10. The punch stamp belongs to a punch tool 11 that is additionally associated with a matrix 12. The punch tool 11 is held in a detachable manner by a support 13 provided on the machine frame 2.

The hydraulic cylinder 7 is controlled by valves 14, 15, which are connected, via lines 16 through 19, to a hydraulic system. The lines 16, 18 are used to transport the pressurized hydraulic fluid to the valves 14, 15. The lines 17, 19 are used to drain the hydraulic fluid coming from the hydraulic cylinder 7. The valves 14, 15 are electrically actuated quick valves that are connected to a control device 20. In addition, a displacement sensor 21 is connected to the hydraulic cylinder 7 in order to detect the position of the hydraulic piston—that is not illustrated in detail—and thus also indirectly detect the position of the punch stamp 10 that is so far rigidly connected to the piston. Alternatively, the displacement sensor 21 may be arranged on the output 8 or on the seat 9.

As described above, the control device 20 is thus connected to the actuating drive 6, as well as to the servo motor 5, in order to control these. In addition, the control device 20 is connected to the displacement sensor 21 and the sensor 6*a* in order to detect the respective actual position of the punch stamp 9 and the electric sheet, respectively. The servo motor 5 and the actuating drive 6 are program-controlled continuously and regulated by the control device, i.e., they can be positioned by position control. Variably adjusted, optimized travel/time curves for both drives may be provided. The "continuous" adjustment is also understood to mean any adjustment, which is specific to very small steps that are, e.g., pre-specified by incremental travel sensors, said steps having a value that is below the required setting accuracy.

Figure 2:
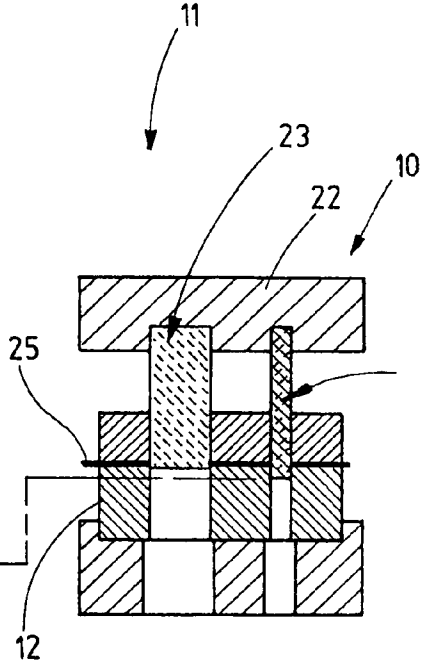
FIG. 2 is a punch tool of the punch device in accordance with FIG. 1.

The punch tool 11 that is shown strictly schematically in FIG. 1 is shown separately in FIG. 2. This tool comprises an upper support 22 belonging to the punch stamp 10, said support holding several, for example two, stamps 23, 24. The stamps 23, 24 may have different lengths, so that they punch through the electric sheet 25 in different positions. In so doing, irrespective of the size of the punch stroke, different hole patterns can be produced in that only the stamp 23, or both stamps 23, 24, punch through the electric sheet 25.

Figure 3:
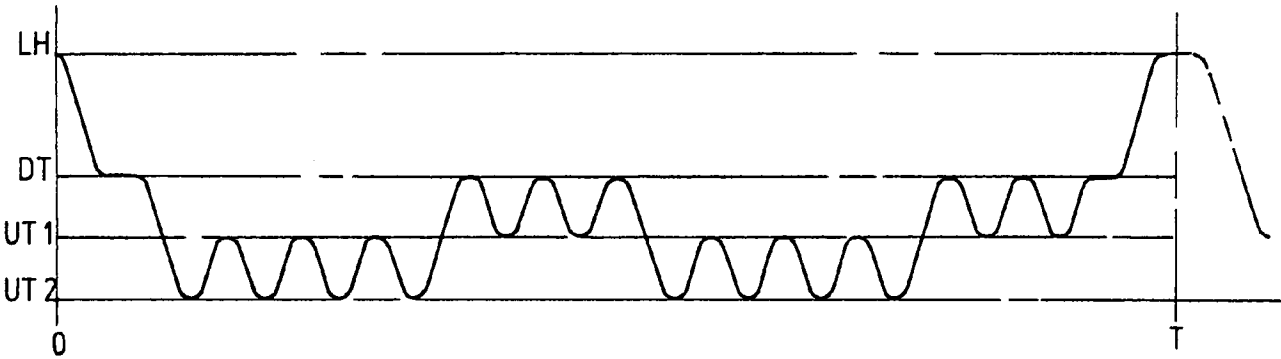
FIGS. 3 and 4 show different travel/time curves illustrating the ram movement to be performed with the device according to the invention.

The punch device 1 described so far operates as follows:

The control device 20 permits the adjustment of a freely programmable ram movement, as well as of a freely programmable movement of the servo motor 5. Optionally, the control device 20 may additionally control a servo motor, said motor moving the table 3 in a controlled manner, in order to offset the notch pressing positions radially with respect to each other, for example. At any time, or in chronologically rapid succession, the control device 20 receives signals from the displacement sensor 21 and the sensor 6*a*, said signals identifying the position of the punch stamp 10, as well as of the electric sheet 25. This control device compares these actual positions with desired positions and appropriately controls the actuating drive 6, as well as the servo motor 5, in order to match the actual positions with the desired positions. In so doing, the control device can move the punch stamp 10 in a specific and continuous manner into the desired positions. FIG. 3 shows a possible travel/time curve for this. In so doing, the punch stamp 10 moves between an upper maximum, said punch stamp reaching said maximum in the so-called lifting stroke LH. The remaining operating cycles can occur between an upper dead center OT, a first lower dead center UT1 and a second lower dead center UT2, which is located lower than the dead center UT1. It is possible to exactly pre-specify the movement of the actuating drive 6 and thus the punch stamp 10, in that the location of the punch stamp 10 is defined for each point in time. In this case, the control device 20 determines the entire curve in accordance with FIG. 3. If only the lower dead center UT1 is reached, only the stamp 24 is active. If the lower dead center UT2 is reached, both punch stamps 23, 24 are active.

It is also possible to pre-specify only those times for ram movement, at which the upper dead center OT, the lower dead center UTI, the lower dead center UT2 and the lifting position LH are to be reached. In this case, the punch stamp 10 is still travel-controlled in the sense that the dead center positions are taken as a result of travel control. The position of the dead centers can be specified continuously.

Figure 4:
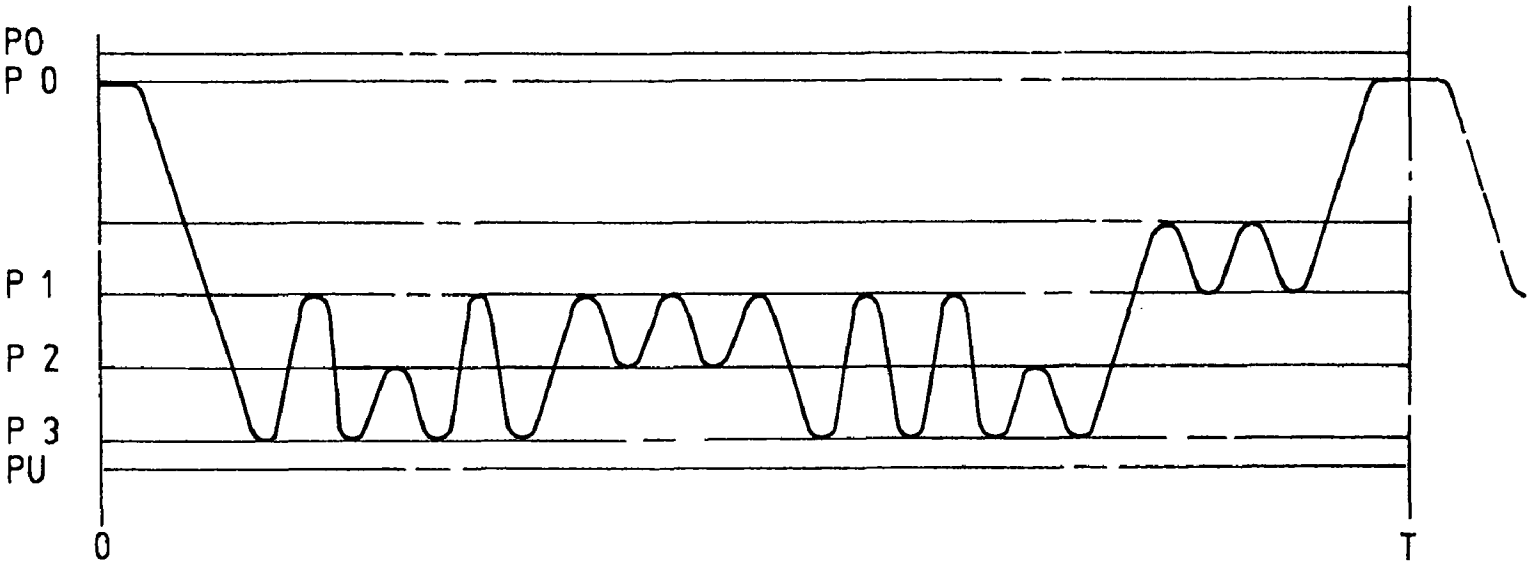

FIG. 4 illustrates a movement cycle, during which various dead centers P0, P1, P2 and P3 can be reached between the maximum possible upper dead center PO and the lowest-possible lower dead center PU. As is obvious, the ram position attained by the hydraulic ram drive is freely programmable within the displacement range of the hydraulic cylinder 7. The specified dead centers, as well as any additional points can be selected randomly within the range of displacement of the hydraulic cylinder 7. In so doing, it becomes possible to also perform punching operations on more than two planes and to achieve an optimal adaptation to the process. In so doing, the ram travel is monitored by means of the travel-measuring system that consists of the travel sensor 21 and the control device 20 connected thereto, so that a positional adjustment can be performed. In addition, it is possible to provide on the hydraulic cylinder 7, and/or on the punch stamp 10, and/or in or on the drive 8, and/or on the seat 9, a pressure sensor or force sensor, so that the force of pressure can also be measured and governed. Moreover, it is possible to provide an overload protection as a result of the use of such sensors. In addition, it is possible to continuously monitor the force of pressure. This monitoring of the force of pressure allows conclusions regarding the punch process, for example, regarding stamp wear or regarding the supply of the wrong material.

The design of the ram drive in accordance with the invention is simple. Mechanical assemblies that are subject to wear are unnecessary, e.g., namely: eccentric cams, mechanical stroke adjustment, clutch, brake, flywheel, belts, levers, etc. In addition, the function of the ventilation stroke is taken over by the hydraulic cylinder 7, so that the assemblies usually required for performing the ventilation lifting stroke can also be omitted.

Another advantage is that a manual ram adjustment is not necessary. This function can also be performed by the hydraulic actuating drive 6.

Referring to a punch device in accordance with the invention, the punch stamp 10 is driven by a hydraulic actuating drive 6, in which case, in connection with an advance device 4 driven by a servo motor and travel-measuring systems on the ram axis and on the partial-apparatus axis (advance axis), the ram movement is freely programmable relative to the advance movement of the partial apparatus.

It will be appreciated that the above description of the present invention is susceptible to various modifications, changes and adaptations, and the same are intended to be comprehended within the meaning and range of equivalents of the appended claims.

The invention claimed is:

1. Device for the automatic punching of circular electric stator sheets and/or rotor sheets, comprising:

a punch tool, which includes a punch stamp and a matrix, said tool producing different punches in an electric sheet in response to different punch stroke lengths;

an actuating drive, which is connected to the punch stamp in order to adjust said punch stamp to perform a variable punch stroke in a travel-controlled manner;

a travel-measuring device for the detection of a position of the punch stamp;

an advance device for the controlled stepwise rotational movement of an electric sheet relative to the matrix; and a control means, which is connected to the actuating drive, to the travel-measuring device and to the advance device for pre-specifying and synchronizing the movement of the punch stamp, including varying the stroke length, and of the advance device during punching and stepwise rotational movement of the electric sheet to produce different shaped punches at selected desired locations on the electric sheet during the stepwise movement, and for producing at least one maximum lifting stroke, which is greater than any stroke length used during punching and advancement, following a specified number of variable length punching strokes of an electric sheet to facilitate removal of a punched sheet from the punching device and insertion of a new sheet to be punched into the punching device.

2. Punch device in accordance with claim 1, wherein the actuating drive is an electric drive.

3. Punch device in accordance with claim 1, wherein the actuating drive is an electric servo drive.

4. Punch device in accordance with claim 1, wherein the actuating drive comprises a hydraulic cylinder containing a piston which is directly connected to the punch stamp.

5. Punch device in accordance with claim 4, wherein the hydraulic cylinder and the piston define the lifting stroke which is greater than any punch stroke.

6. Punch device in accordance with claim 5, wherein the lifting stroke which is greater than any punch stroke, results in the punch stamp and the matrix being far enough apart from each other so that the electric sheet can be moved with the use of a gripper means into, or out of, the punch device.

7. Punch device in accordance with claim 4, wherein the hydraulic cylinder is controlled by electrically actuated valves.

8. Punch device in accordance with claim 1, wherein the control means is set up to vary a lower dead center of the punch stamp while an electric sheet is being machined.

9. Punch device in accordance with claim 1, wherein the control means is set up to vary an upper dead center of the punch stamp while an electric sheet is being machined.

10. Punch device in accordance with claim 1, wherein the advance device comprises a servo motor that is directly connected to a seat for the electric sheet.

11. Punch device in accordance with claim 1, wherein the advance device is connected to a further travel-measuring device in order to permit the stepwise position-controlled advance movement of the electric sheet.

* * * * *